US011370231B2

(12) United States Patent
Kain et al.

(10) Patent No.: US 11,370,231 B2
(45) Date of Patent: Jun. 28, 2022

(54) PIVOTED ELLIPTICAL REFLECTOR FOR LARGE DISTANCE REFLECTION OF ULTRAVIOLET RAYS

(71) Applicant: Phoseon Technology, Inc., Hillsboro, OR (US)

(72) Inventors: Patrick Kain, Portland, OR (US); Garth Eliason, Hood River, OR (US)

(73) Assignee: Phoseon Technology, Inc., Hillsboro, OR (US)

( * ) Notice: Subject to any disclaimer, the term of this patent is extended or adjusted under 35 U.S.C. 154(b) by 363 days.

(21) Appl. No.: 15/945,571

(22) Filed: Apr. 4, 2018

(65) Prior Publication Data

US 2018/0290462 A1 Oct. 11, 2018

Related U.S. Application Data

(60) Provisional application No. 62/483,252, filed on Apr. 7, 2017.

(51) Int. Cl.

| | |
|---|---|
| ***B41J 11/00*** | (2006.01) |
| ***F21V 5/04*** | (2006.01) |
| ***F21V 7/08*** | (2006.01) |
| ***B41M 7/00*** | (2006.01) |
| ***F21V 7/06*** | (2006.01) |
| *F21Y 115/10* | (2016.01) |

(52) U.S. Cl.

CPC ..... *B41J 11/00218* (2021.01); *B41M 7/0081* (2013.01); *F21V 5/048* (2013.01); *F21V 7/06* (2013.01); *F21V 7/08* (2013.01); *F21Y 2115/10* (2016.08)

(58) Field of Classification Search

CPC ..... B41J 11/002; B41J 11/00218; B41M 7/0081; F21V 5/048; F21V 7/06; F21V 7/08; F21Y 2115/10

See application file for complete search history.

(56) References Cited

U.S. PATENT DOCUMENTS

| | | | | |
|---|---|---|---|---|
| 7,580,192 | B1 * | 8/2009 | Chu | F21V 7/0091 359/641 |
| 8,869,419 | B2 | 10/2014 | Karlicek, Jr. et al. | |
| 2003/0081430 | A1 * | 5/2003 | Becker | A61C 19/004 362/573 |

(Continued)

FOREIGN PATENT DOCUMENTS

| | | | |
|---|---|---|---|
| JP | 2016111340 | A | 6/2016 |
| KR | 20140035145 | A | 3/2014 |

OTHER PUBLICATIONS

ISA Korean Intellectual Property Office, International Search Report and Written Opinion Issued in Application No. PCT/US2018/026114, Jul. 26, 2018, WIPO, 16 pages.

*Primary Examiner* — Robert S Walters, Jr.

(74) *Attorney, Agent, or Firm* — McCoy Russell LLP

(57) ABSTRACT

Systems and methods for achieving increased irradiation and/or illumination in a photo reactive system is disclosed. In one example, a photo reactive system includes a light source, a refractive cylindrical optic, and a curved reflector. By utilizing the refractive cylindrical optic, angular spread of the light source is reduced, which in turn reduces a size of the curved reflector for directing the light rays onto a work piece. Consequently, a more compact photo reactive system with higher irradiation and/or illumination capabilities can be achieved.

17 Claims, 15 Drawing Sheets

(56) References Cited

U.S. PATENT DOCUMENTS

| | | | |
|---|---|---|---|
| 2004/0075047 | A1 | 4/2004 | Schnitzlein et al. |
| 2010/0223803 | A1 | 9/2010 | Karlicek, Jr. et al. |
| 2010/0260945 | A1 | 10/2010 | Kites et al. |
| 2011/0147356 | A1 | 6/2011 | Leonhardt et al. |
| 2014/0105784 | A1 | 4/2014 | Smeeton et al. |

* cited by examiner

PIVOTED ELLIPTICAL REFLECTOR FOR LARGE DISTANCE REFLECTION OF ULTRAVIOLET RAYS

CROSS REFERENCE TO RELATED APPLICATIONS

The present application claims priority to U.S. Provisional Application No. 62/483,252, entitled "PIVOTED ELLIPTICAL REFLECTOR FOR LARGE DISTANCE PROJECTION OF ULTRAVIOLET RAYS," filed on Apr. 7, 2017. The entire contents of the above-listed application are hereby incorporated by reference for all purposes.

FIELD

The present description relates to systems and methods for collecting radiant flux of an Ultraviolet (UV) light source, and improving its irradiance and/or illuminance.

BACKGROUND AND SUMMARY

Ultraviolet (UV) solid-state lighting devices such as laser diodes and light-emitting diodes (LEDs) may be used for photosensitive media curing applications such as coatings, including inks, adhesives, preservatives, etc. For some applications, such as sheet-fed offset printing, larger working distances between the light source and a work piece including curable media are desired. For example, in sheet-fed offset printing, larger working distances (e.g., >75 mm) are desired to avoid dispersive ink contamination to the light source. Further, as the working distance increases, advanced optics, such as curved reflectors (e.g., elliptical or parabolic reflectors), may be used to collimate or focus the light energy onto the work piece.

One such example method using curved reflectors is shown in U.S. Pat. No. 8,869,419. Therein, LED arrays are directly imaged via parabolic or elliptical reflectors. Specifically, LED arrays are placed along a first focal line f1 of the curved reflector and imaged linearly at the second focal line f2 of the reflector. However, inventors have identified potential issues with such an approach.

As one example, radiant flux from the LED arrays are directed to the curable media via the reflector at an angle different from normal for all parameters of the reflector, which reduces the irradiance at the curable media. Furthermore, the rays emitted from the LED arrays are at a large angular divergence (that is, angular spread), which necessitates a larger reflector to collect the flux. The larger reflector results in a longer optical path length, which in turn decreases the irradiance at the curable media.

In one example, the issues described above may be addressed by a lighting system, comprising: a light source; a refractive cylindrical optic; and a curved reflector; wherein the light source is positioned within a focal length of the cylindrical optic to generate a virtual image of the light source; wherein the curved reflector is positioned such that the virtual image of the light source is along a first focal plane of the reflector; and wherein the curved reflector is adjusted to reimage the virtual image and generate a multi-dimensional column of light, the multi-dimensional column of light delivered onto a work piece.

In this way, by utilizing a refractive cylindrical optic, divergence of the light from the one or more light emitting devices is reduced. As a result, a smaller curved reflector can be used to collect the rays, which in turn reduces the optical path length. Thus, for a given mechanical distance between the light source and the work piece, a much higher irradiance can be achieved by utilizing the cylindrical optic than with the curved reflector alone.

As an example, a light source may include one or more discrete light emitting devices arranged in a one-dimensional or two-dimensional array. The light source may be positioned within a focal length of a refractive cylindrical optic, such as a plano-convex lens, to generate a virtual image. The virtual image thus generated has a less angular spread than the rays emitted by the light source. For example, a first angle of an emitting ray from the light source with respect to a central emitting ray is greater than a second angle of an emitting ray from the virtual image with respect to the central ray. Thus, a smaller curved reflector (e.g., with a shorter major axis or minor axis) may be used to capture and reimage the virtual image generated by the cylindrical optic. The curved reflector may be an elliptical or parabolic reflector, for example. In order to reimage the virtual image, the virtual image may be positioned at a first focal plane of the curved reflector. The curved reflector may generate a focused light at a second focal plane via internal reflection. When a smaller curved reflector is used, an optical path length of the light source is shorter, which in turn results in increased irradiance delivered to a curable media.

Further, the curved reflector may be adjusted such that it is pivoted at an angle with respect to an optical axis of the light source in order to deliver at least a portion of the reflected light at an angle normal to the second focal plane. This adjustment of the curved reflector to provide normal incidence increases an intensity of irradiation and/or illumination delivered to a curable media.

Furthermore, the curved reflector may generate a multi-dimensional column of light at immediate parallel plane locations (within a threshold distance) above or below the second focal plane. Since at least a portion of the reflected light is incident normal to parallel plane locations, the intensity of the irradiation and/or illuminance at these parallel planes does not vary (decrease) greatly, and these planes may be effectively used as irradiance planes to cure a work piece including a curable media. When multi-dimensional column of irradiance with normal incidence as discussed above is used to irradiate a work piece, a surface area of the workpiece cured at a given time duration is greater than a surface area of workpiece cured with a single-dimensional line of irradiance. Consequently, faster curing in a more compact lighting system is achieved.

The above advantages and other advantages, and features of the present description will be readily apparent from the following detailed description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

The present description is related to systems and methods for collecting radiant flux of an Ultraviolet (UV) light source, and generating an irradiance pattern at a specific location. Typically, light from a source, such as a UV source, has an emission envelop with a wide angle of divergence. A large curved reflector is required in order to collect the emitting rays and direct them to a work piece or surface at a specified distance from the source. The increased optical path length through which the light rays propagate causes a reduction in the irradiance and/or illuminance delivered to the work piece. In addition, the light does not propagate normal to the work piece, which further reduces the irradiance. Adjustments to affect light propagation normal to the work piece are complex requiring adjustments to the alignment of the light source and reflector, which cannot be done in a translational manner if either the light source or the reflector has to be replaced. For example, each reflector may be configured with a specific working distance (that is, distance between the light source and the curable media). Thus, when a customer desires to change the working distance, the lighting system is replaced with a reflector having the desired working distance. Under such conditions, since the reflector is not configured to deliver irradiance normal to the curable media, complex adjustments requiring adjustment of the mounting angle of the light source, and the angle between the light source and the reflector. This has to be performed by the customer, which may not result in the desired outcome leading to customer dissatisfaction.

Figure 1:
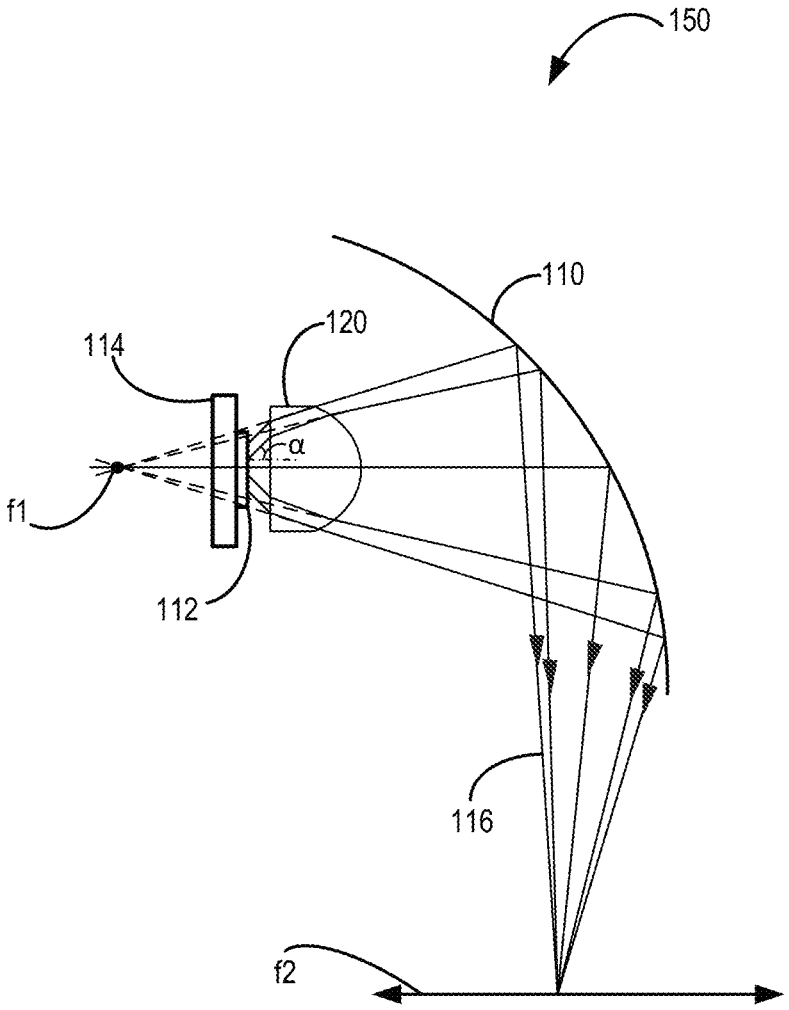
FIG. 1 is a schematic depiction of a lighting system including a light source, a refractive cylindrical optic, and a curved reflector.
Figure 2:
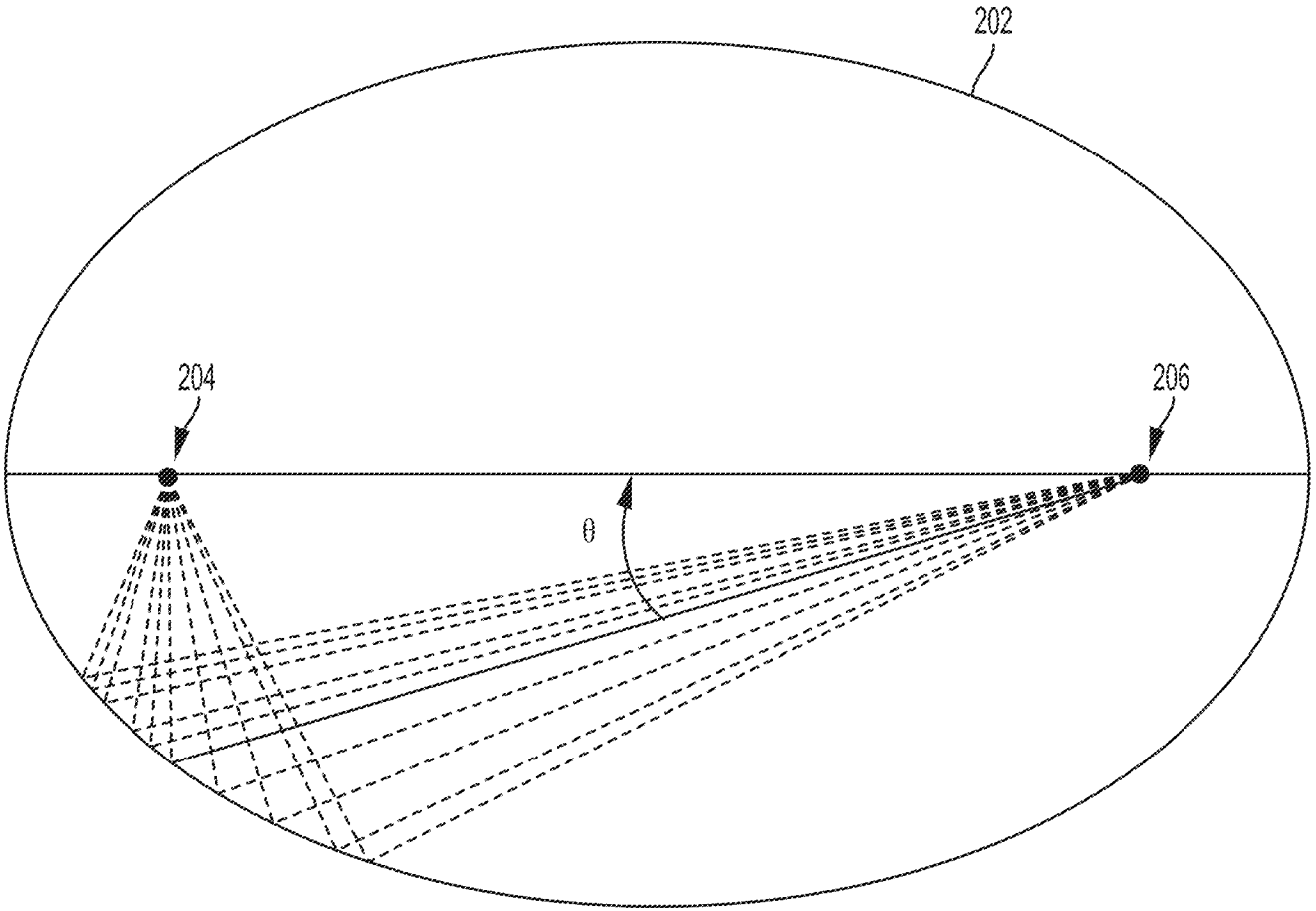
FIG. 2 is a schematic depiction of an angle of light delivered to a curable media or workpiece using a curved reflector in the absence of a cylindrical optic.
Figure 4A:
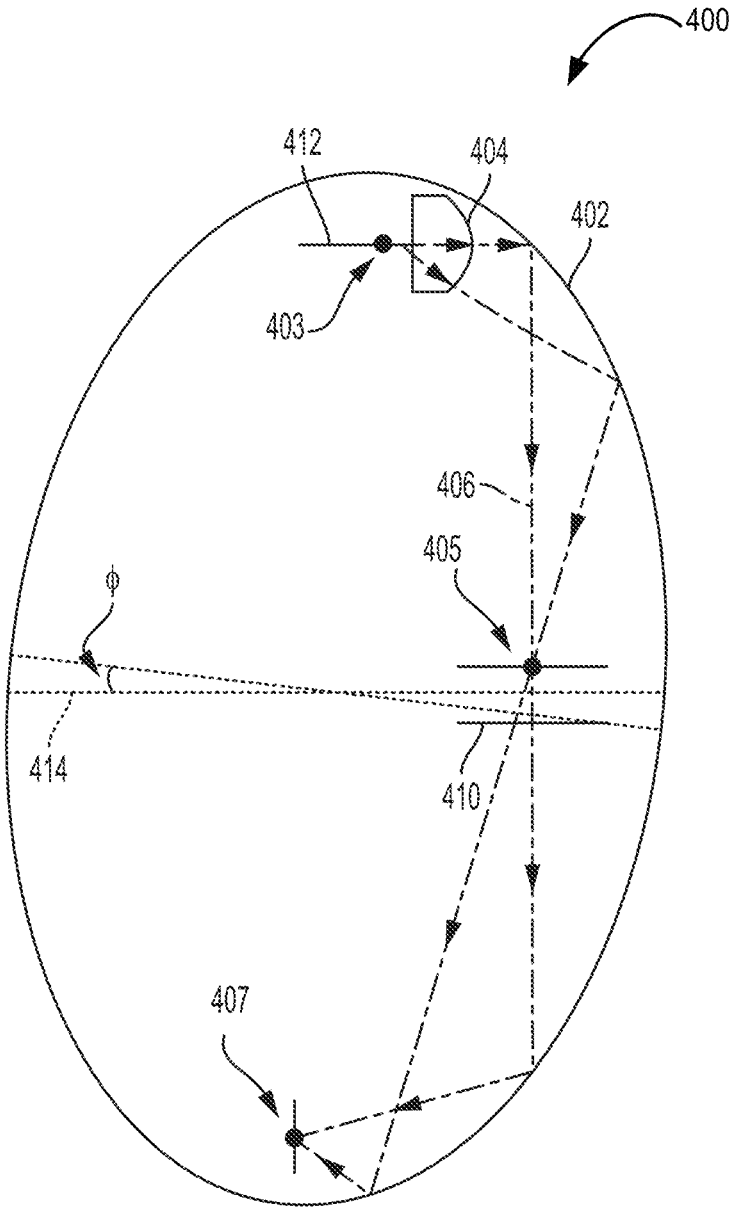
FIG. 4A is a schematic depiction of an angle of tilt φ provided to the elliptical reflector such that at least a portion of light delivered to the curable media is normal to the curable media.
Figure 4B:
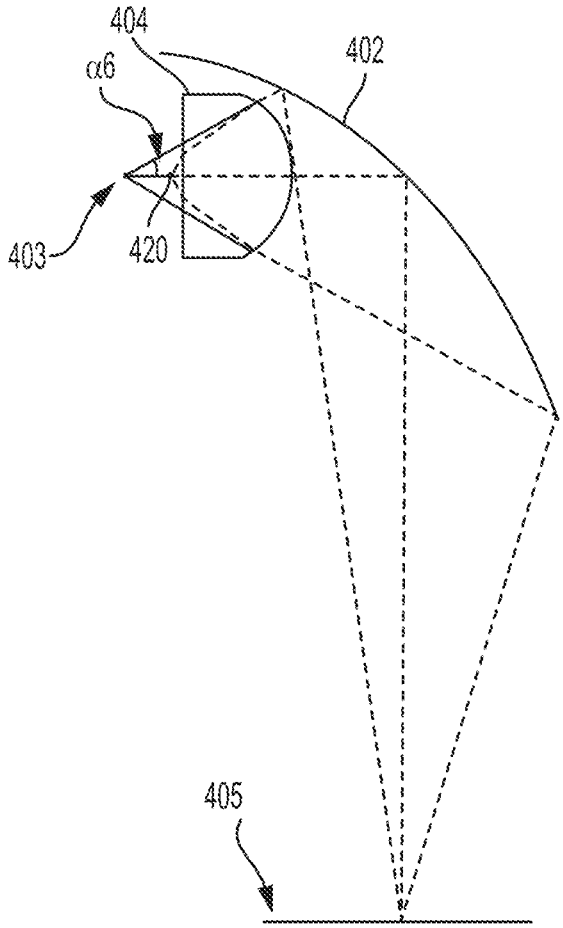
FIG. 4B is a schematic depiction of an enlarged portion of the elliptical reflector of FIG. 4A.
Figure 5:
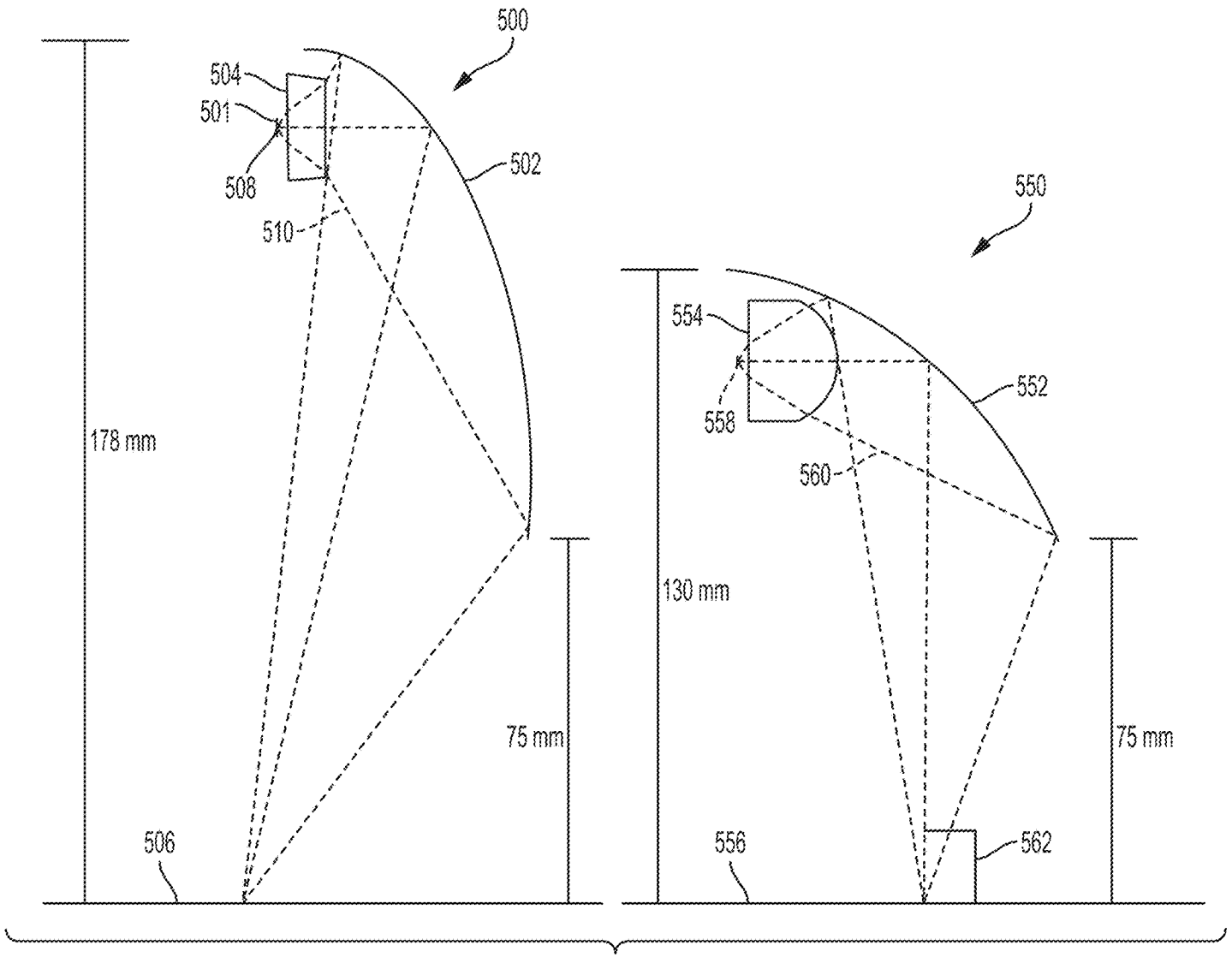
FIG. 5 is a schematic depiction of the reduction in size of the elliptical reflector achieved with a cylindrical optic in comparison with a system without the cylindrical optic.
Figure 6:
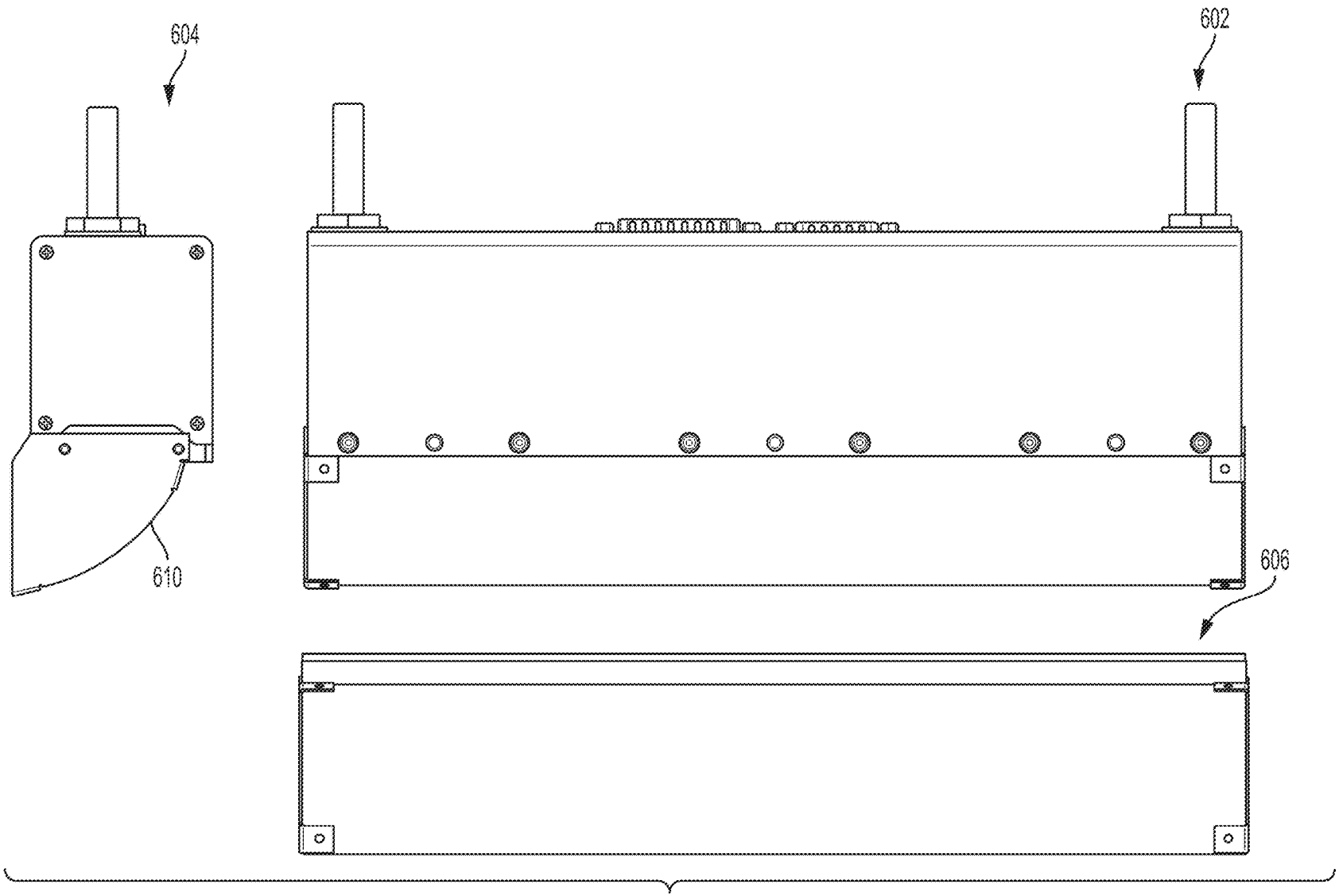
FIG. 6 is a schematic depiction of a lighting system without a cylindrical optic.
Figure 7:
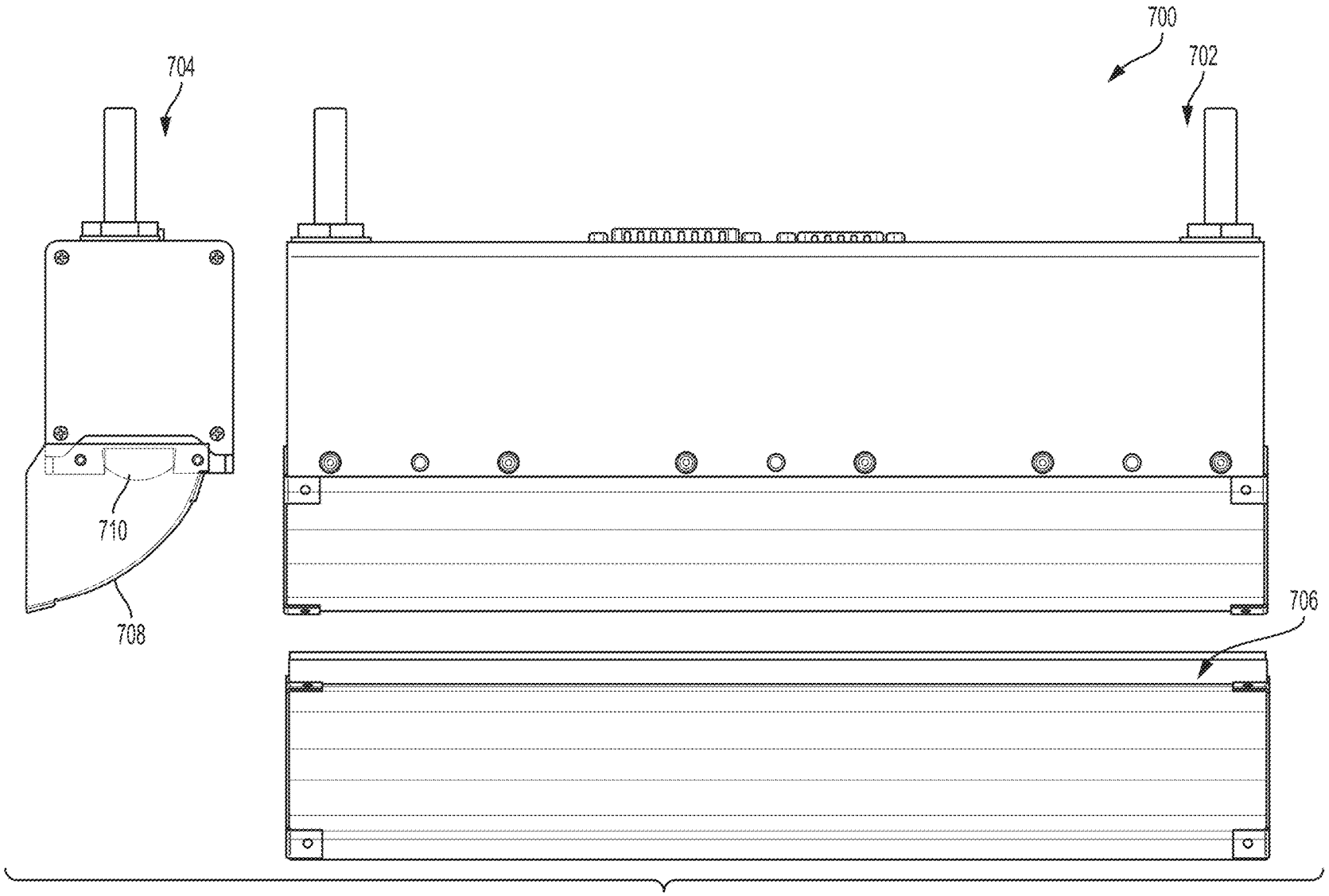
FIG. 7 is a schematic depiction of a lighting system with a cylindrical optic.
Figure 8:
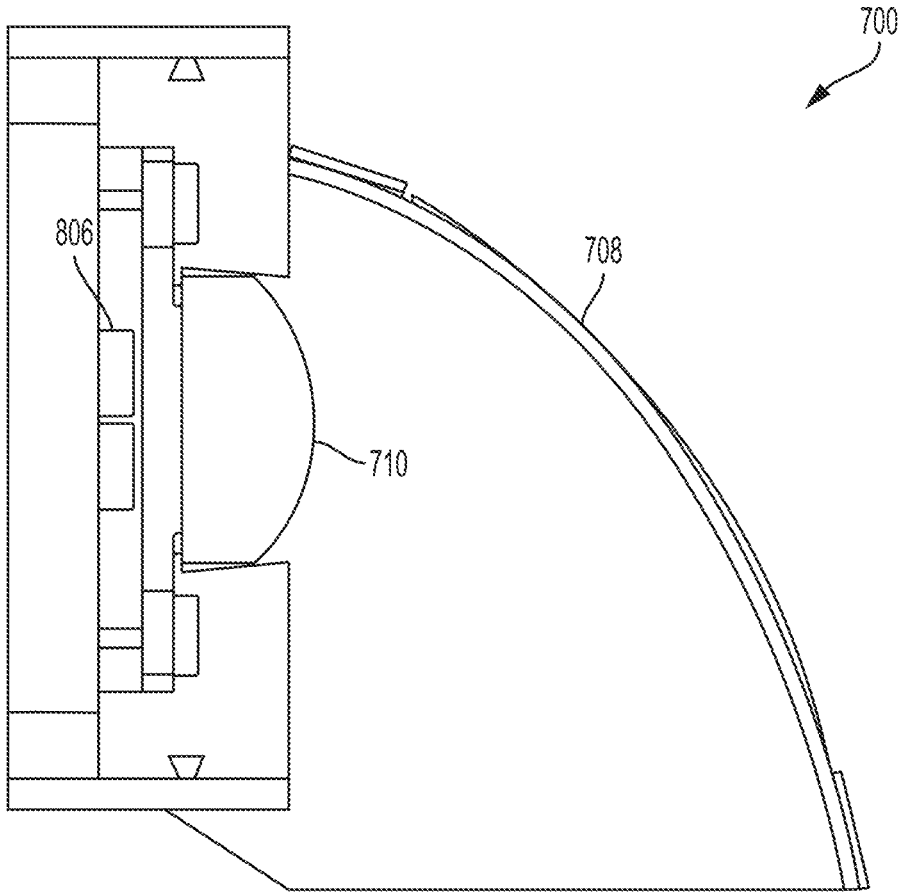
FIG. 8 shows a cross-section of a lighting system with a cylindrical optic, such as the cylindrical optic of FIG. 7.
Figure 9:
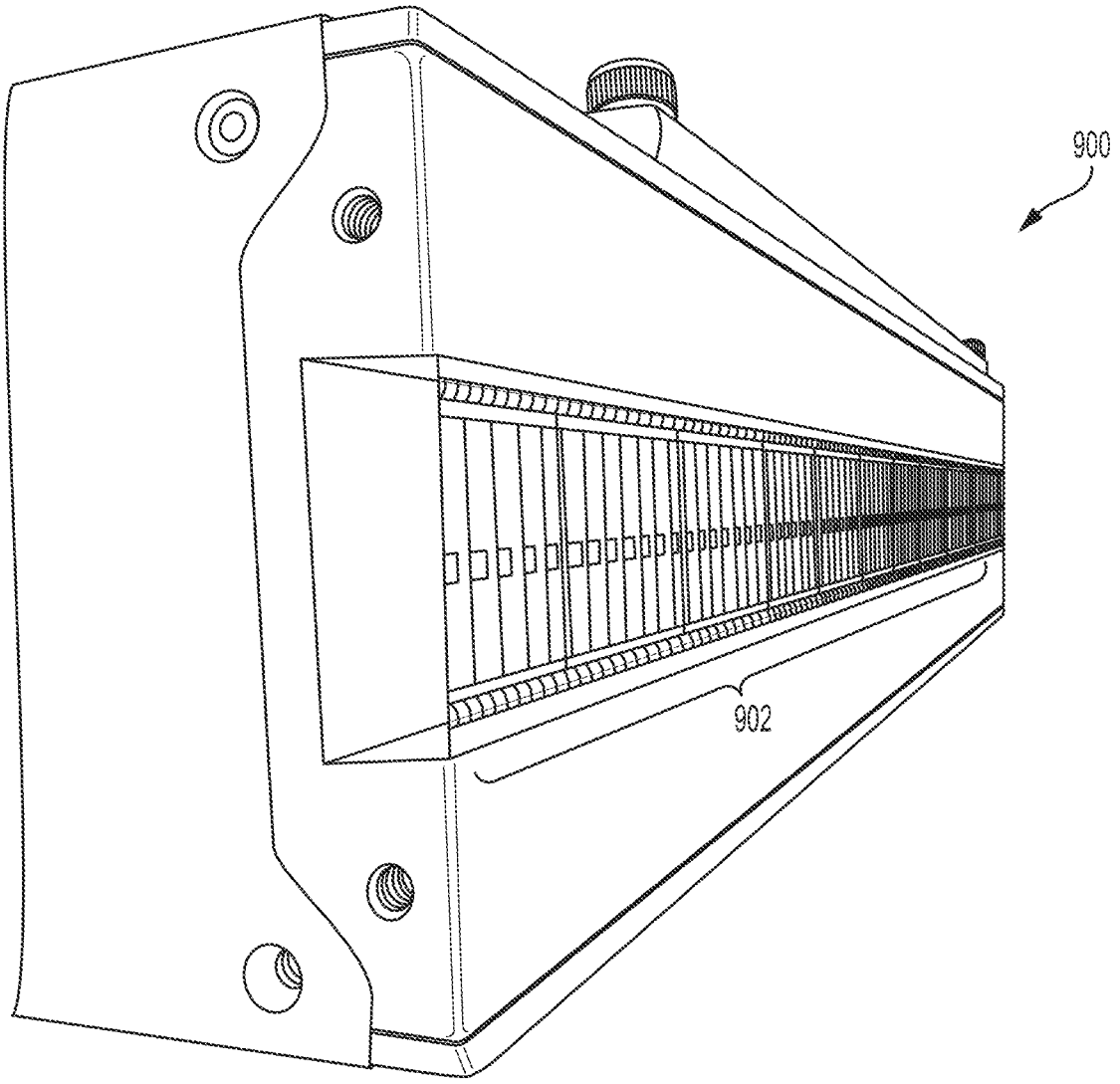
FIG. 9 shows an example one-dimensional array of one or more discrete light sources in a lighting system, such as the lighting system shown in FIG. 6 or 7.
Figure 10:
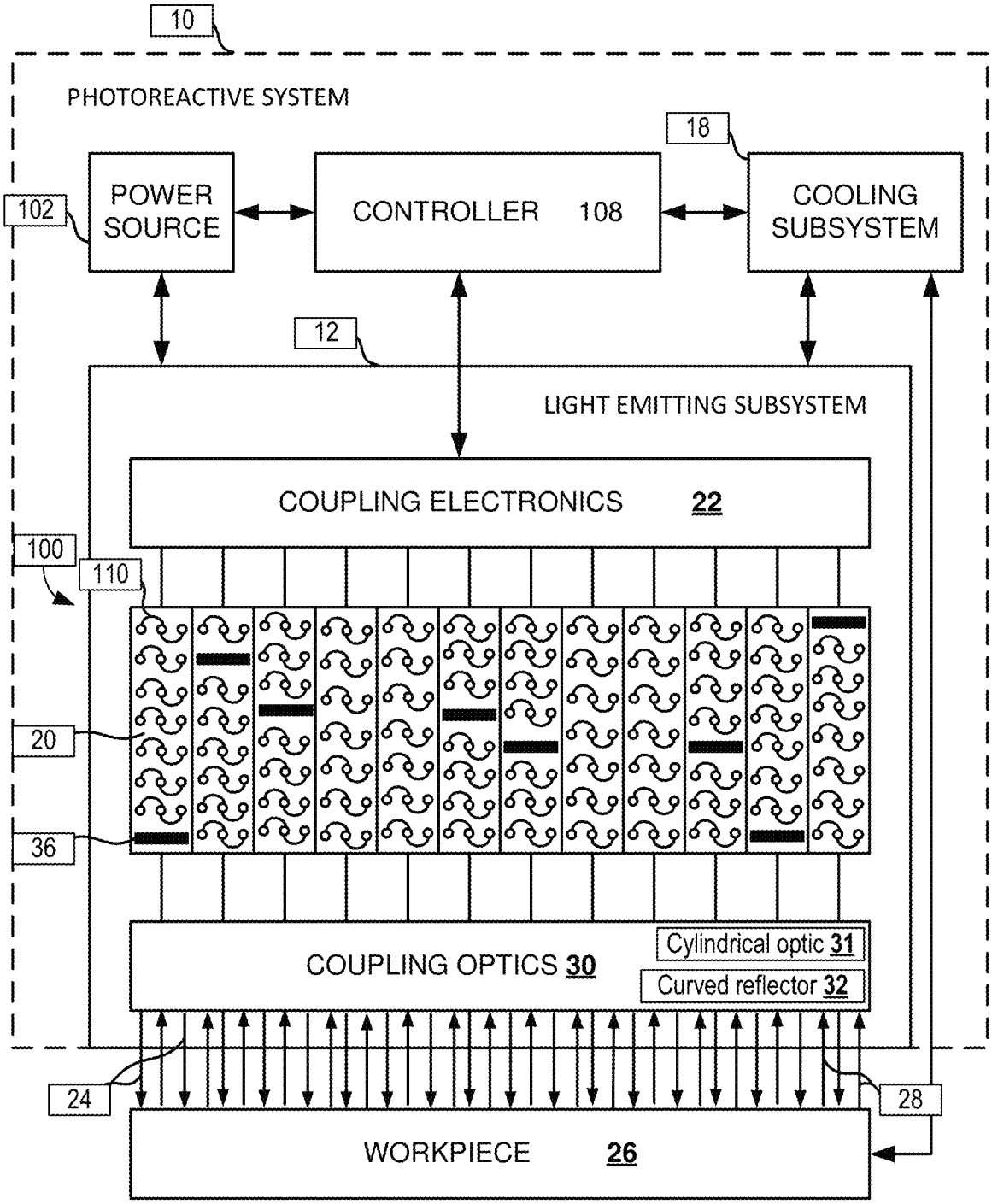
FIG. 10 shows a schematic depiction of a photo reactive system including a lighting system with a cylindrical optic, such as the lighting system of FIG. 7.
Figure 11:
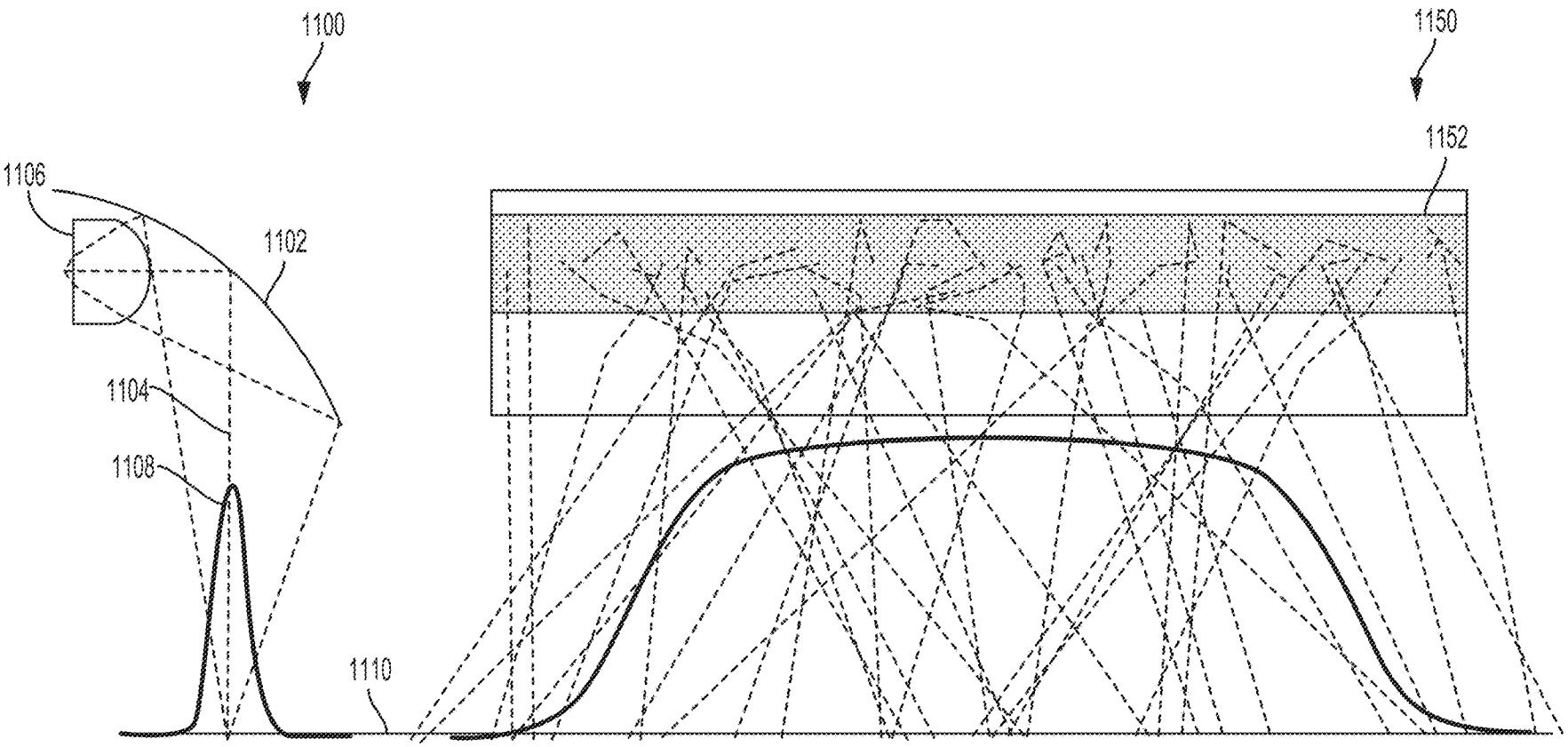
FIG. 11 illustrates an example map of distribution of irradiance on a work piece including curable media.
Figure 12:
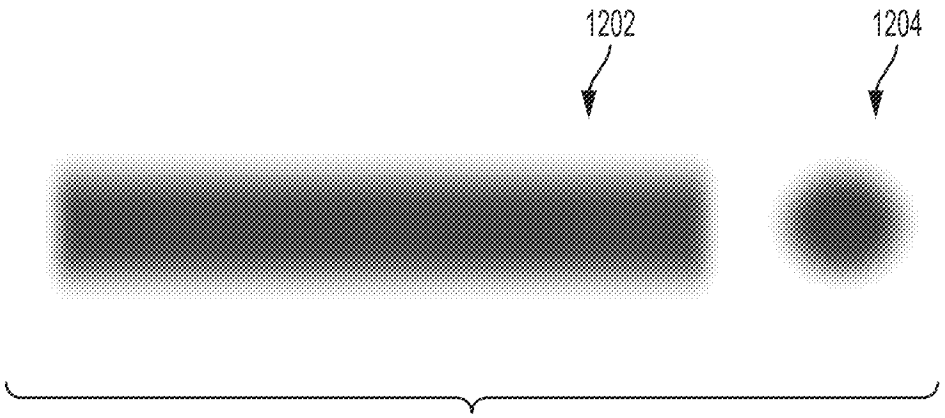
FIG. 12 illustrates an example multi-dimensional band/column of light generated at the curable media by utilizing a cylindrical optic and a curved reflector in a lighting system, according to the present invention.

The inventors herein at least partially address the forgoing issues by providing a lighting system, such as the lighting system of FIG. 1 with improved irradiance and/or illumination, reduced size, and simplified installation. The lighting system includes a light source, a refractive cylindrical optic, and a curved reflector for focusing or collimating light energy onto a substrate or a workpiece. Specifically, the refractive cylindrical optic is utilized for reducing an angular spread (interchangeably referred to herein as angle of divergence), of light rays emitted by the light source, as elaborated in FIGS. 3A and 3B. When all of the light energy delivered to the work piece is not incident at an angle normal to the work piece, as shown in FIG. 2; the curved reflector may be adjusted to direct at least a portion of light rays at an angle normal to the work piece, as depicted in FIGS. 4A and 4B. Further, a reduction in size of the curved reflector is achieved by utilizing the refractive cylindrical optic is illustrated at FIG. 5. An example of a lighting system, such as the lighting system in FIG. 1, (without the cylindrical optic), is shown in FIG. 6. An example of a lighting system with a cylindrical optic is shown at FIGS. 7 and 8, and an example of a one-dimensional array comprising a plurality of discrete light sources is shown at FIG. 9. Further, a schematic depiction of a photo reactive system including a lighting system and coupling optics comprising a refractive cylindrical optic and a curved reflector according to the present invention is shown in FIG. 10. By utilizing the cylindrical optic in coordination with the curved reflector, the irradiance achieved with the lighting system may be increased. An example intensity map is shown at FIG. 11. The irradiation may be delivered as a multi-dimensional uniform column of light. One example multi-dimensional column of light is shown at FIG. 12. Furthermore, an example method of manufacturing the lighting system with the cylindrical optic is described at FIG. 13.

Turning to FIG. 1, an example lighting system 150 for irradiating a work surface or substrate including curable media is shown. The lighting system includes a curved reflector 110, a refractive cylindrical optic 120, and an array of LEDs 114 (light source). The curved reflector is used for focusing light energy from the array of LEDs 114 via the refractive cylindrical optic 120, as depicted by rays 116.

The array of LEDs 114 includes a plurality of discrete LEDs 112. In one example, the discrete LEDs may be arranged in a one-dimensional array. However, a multi-dimensional arrangement of the discrete LEDs is also possible. The refractive cylindrical optic 120 may be a plano-convex lens. Other types of refractive cylindrical optics are also within the scope of this disclosure. The curved reflector 110 may be configured as an elliptical or parabolic reflector.

Energy from the light source may be collected by the curved reflector 110 and delivered as irradiance to the work piece. The irradiance may be focused linearly along focal line f2. The focal line is defined as a focused line formed after the light rays pass through an optic lens. Specifically, the reflector 110 and the cylindrical optic 120 may be configured to create substantially uniform focused irradiance at f2. Further, the reflected rays are delivered at an angle that is not normal to the focal line f2. An angle θ of a reflected ray delivered to a work piece including curable media at the focal line f2 with respect to the surface of the curable media (also referred to as irradiance plane) receiving the ray is shown in FIG. 2. Specifically, FIG. 2 shows a curved reflector 202 configured as an elliptical reflector including conjugate foci 204 and 206. Rays from a light source placed at 204 may be delivered at an angle θ to the curable media placed at 206. The angle θ may not be normal to the curable media. In order to increase the irradiance, the reflector may be adjusted. Specifically, the reflector may be pivoted so as to deliver at least a portion of the light energy normal to the curable media. Details of adjusting the reflector is further elaborated with respect to FIG. 4A.

Returning to FIG. 1, for the lighting system 150, the rays emitted by the LEDs 114 have a large angle of divergence α. The angle of divergence α is defined as an angle between an emitting ray of the LED and a center ray (or center line) of the LED, which is perpendicular (i.e. normal), to the emitting surface of the LED. In the absence of the refractive cylindrical optic 120, due to the large angle of divergence α, a larger reflector is required to collect all the emitting rays from the array of LEDs. As the size of the reflector increases, an optical path length of the emitting rays also increase, which causes a reduction in the intensity of irradiance and/or illumination available for delivering to a curable media.

The forgoing issues arise as a consequence of using a reflector for directly collimating or focusing the light rays from the light source. This can be partially addressed by utilizing a cylindrical optic, such as the cylindrical optic 120. Specifically, the cylindrical optic 120 may be used to reduce the angle of divergence of the rays impinging on the reflector, and to deliver at least a portion of the reflected rays normal to the surface of the curable media. An example effect of using a cylindrical optic for reducing the angle of divergence of emitting rays is further elaborated with respect to FIGS. 3A and 3B.

Figure 3A:
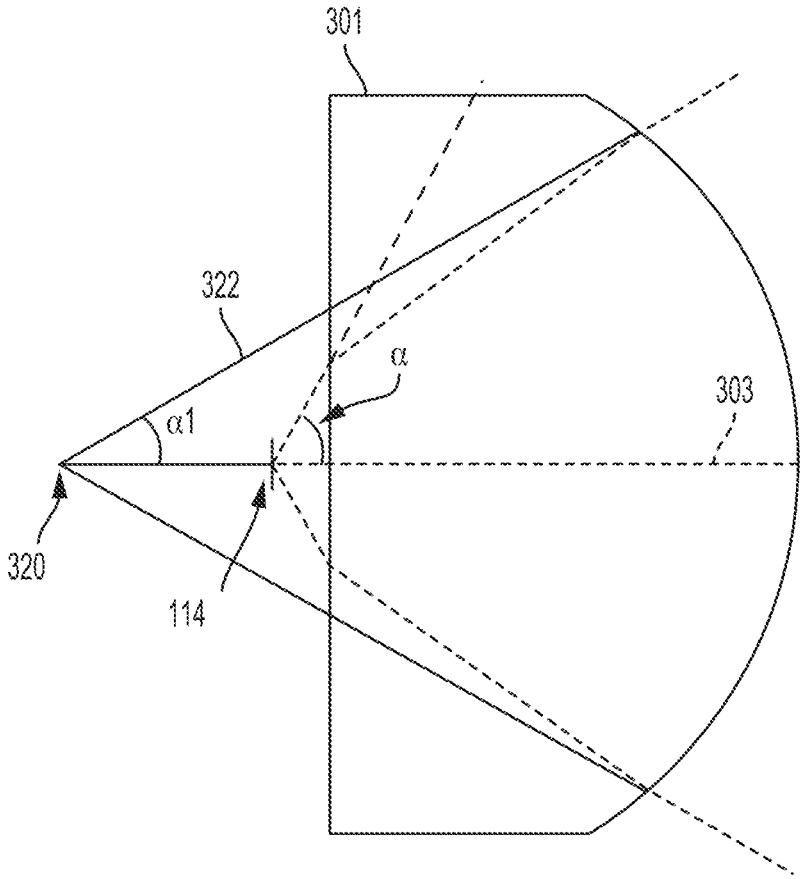
FIG. 3A is a schematic depiction of utilizing a cylindrical optic on the angle of divergence (angular spread) of rays emitted by a light source.

Turning to FIG. 3A, an angle of divergence α without using a cylindrical optic is illustrated, and an angle of divergence α1 of a ray impinging on a curved reflector with a refractive cylindrical optic 301 is shown. In the example illustrated herein, a plano-convex lens is used to reduce the angle of divergence (also referred to herein as angular spread) of emitting rays from a light source. When a light source, such as an LED array 114, is positioned within a focal length of the cylindrical optic 301, a virtual image 320 is formed behind the cylindrical optic. A focal length of an optic may be defined as a distance between a center of the optic and a focal point of convergence (or divergence) of parallel light rays passing through the optic. The virtual image is then positioned at a first conjugate foci of a curved reflector, such as conjugate foci 204 shown at FIG. 2, and reimaged at a second conjugate foci of a curved reflector, such as conjugate foci 206 shown at FIG. 2. As shown, the angle of divergence α1 of an emitting ray 322 of the virtual image from a central emitting ray 303 is less than the angle of divergence α. Thus, by utilizing the cylindrical optic 301, an angle of divergence (angular spread) of the emitting rays from a light source is reduced.

Figure 3B:
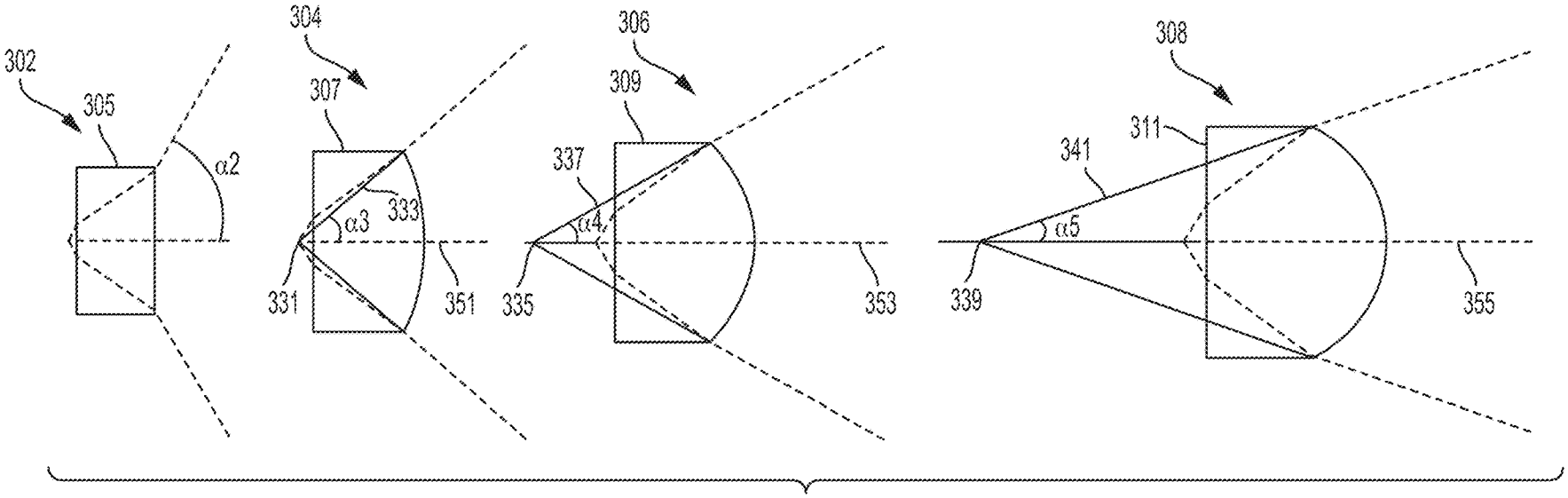
FIG. 3B is a schematic depiction of change in the angle of divergence based on a radius of curvature of a cylindrical optic.

Further, a degree of reduction of the angle of divergence is based on a radius of curvature of the cylindrical optic. For a plano-convex lens 301 as shown in FIG. 3A, a change in reduction in the angle of divergence based on the radius of curvature of the cylindrical optic is shown in FIG. 3B. Turning now to 3B, at 302-308, the effect of utilizing different refractive cylindrical optics with different radius of curvature is illustrated. As discussed above, when the light source is positioned within a focal length of the cylindrical optic, the emitting rays from the light source converge behind the lens forming a virtual image of the light source. Depending on the radius of curvature of the cylindrical optic, the angle of divergence of an emitting ray of the virtual image and a central ray changes. Specifically, as the angle of divergence (and hence, angular spread) decreases with decrease in radius of curvature of the cylindrical optic. For example, at 302, an optic 305 having a large radius of curvature (and hence, appears to be flat) is shown. At 304, a plano-convex lens 307 with a first radius of curvature less than the radius of curvature of optic 305 is shown. As depicted, when optic lens 307 is used, a first virtual image is formed at 331, and the angle of divergence α3 of an emitting ray 333 of the first virtual image and a central ray 351 is less than α2 when optic 305 is provided. At 306, a second plano-convex lens 309 with a second radius of curvature less than the first radius of curvature is utilized. When the second lens 309 is used, a second virtual image is formed at 335. The angle of divergence α4 of an emitting ray 337 of the second virtual image and a central ray 353 is less than α3 and α2. At 308, a third plano-convex lens 311 with a third radius of curvature less than the first and second plano-convex lenses is utilized. When the third lens 311 is used, a third virtual image is formed at 339. The angle of divergence α5 of an emitting ray 341 of the third virtual image and a central ray 355 is less than α4, α3, and α2. Thus, angle of divergence $\alpha 5<\alpha 4<\alpha 3<\alpha 2$. That is, as the radius of curvature decreases, angle of divergence also decreases. As the angular divergence decreases, a size of the reflector utilized for collimating or focusing the emitting rays onto the curable media also decreases, which in turn reduces the optical path length of the emitting rays, thereby increasing irradiance and/or illuminance at the curable media.

A portion of a lighting system 400 is illustrated in FIG. 4A, which includes an elliptical reflector 402 and a refractive cylindrical optic 404. Specifically, the angle at which reflected rays from the elliptical reflector 402 are incident at a focal plane 405 of the elliptical reflector 402 is shown. A focal plane is defined as a plane that passes through a focal line or focal point of an optic lens or mirror (e.g., reflector). The elliptical reflector 402 includes a first focal plane 403, a second focal plane 405, and a third focal plane 407. A light source, such as an LED array (not shown) is positioned such that it is within a focal length of the cylindrical optic 404. The refractive cylindrical optic 404 shown here may be configured as a plano-convex lens. However, it will be appreciated that other types of cylindrical optics may be used, such as bi-convex, and meniscus shape factors, as well as cylindrical linear Fresnel lenses.

When the light source is positioned within a focal length of the cylindrical optic 404, the emitting rays from the light source converge behind the lens forming a virtual image of the light source. For example, if a light source, such as an array of LEDs comprising a single row of densely arranged discrete LED emitters, is positioned within a focal length of the cylindrical optic 404; a virtual image of the array is formed behind the lens; (e.g. the virtual image may be a linear or quasi-linear representation of the array). That is, the virtual image is formed to the left of the cylindrical optic 404 from a view point of an observer facing the optic. The position of the light source is then adjusted so that the virtual image of the light source is positioned at a first focal plane 403 of the elliptical reflector 402. The positioning of the virtual image thus coincides with a first focal line in the first focal plane 403 of the elliptical reflector 402. The emitting rays of the virtual image have less angular spread than the emitting rays of the light source. Thus, a smaller elliptical reflector may be used than when the light source is imaged directly without using the cylindrical optic. The positioning of the light source and the virtual image, and the resulting reduction in angular spread is shown at FIG. 4B. An enlarged schematic depiction of a portion of the curved reflector 402 is shown in FIG. 4B. Positioning of the light source is indicated at 420, and the positioning of the virtual image is at first focal plane 403. Further, an angle of divergence of an emitting ray with respect to a central ray is indicated as a6. The angle of divergence α6 may be less than an angle of divergence of an emitting ray with respect to the central ray in the absence of the cylindrical optic.

An angle of pivot φ with respect to an axis 414 is shown in FIG. 4A and is parallel to the optical axis 412 of the light source. The angle of pivot φ may be provided to the elliptical reflector 402 such that at least a portion of the reflected rays are delivered at an angle normal to the second focal plane 405. An example ray delivered normal to the focal plane 405 is indicated at 406. The focal plane 405 includes a focal line at which a focused line of light is generated. In one example, the curable media, such as depicted in plane 410, may be positioned at a parallel plane immediately above or below the focal plane in order to generate a multi-dimensional column of light, thereby obtaining a more uniform illumination and/or irradiation of the curable media. Further, a surface area of the curable media irradiated and/or illuminated at plane 410 by the multi-dimensional column of light may be greater than a surface area of the curable media irradiated and/or illuminated at the second focal plane 405. Furthermore, the portion of reflected rays may continue to be delivered normal at plane 410 and hence the intensity of the irradiation or illumination may not vary greatly. Plane 410 may also be within a threshold distance from the second focal plane such that a reduction in the intensity of irradiation at 410 is not greater than a threshold reduction. The curable media may alternately be placed at the second focal plane 405, where an intensity of irradiation and/or illumination is higher.

The angle of pivot φ may be different for different sizes of reflectors. For example, as the size of the reflector increases, a greater angle of tilt can be achieved. The size of the elliptical reflector may be reduced by utilizing the cylindrical optic 404, which enables a smaller angle of pivot φ to achieve normal incidence on the curable media. An example difference in size of the elliptical reflector with and without the cylindrical optic is illustrated at FIG. 5.

A comparison of a portion of a lighting system 500 without a cylindrical optic, and a portion of a lighting system 550 including a cylindrical optic is shown in FIG. 5. Lighting system 500 includes a curved reflector 502 and a plano lens 504, while lighting system 550 includes a curved reflector 552 and a refractive cylindrical optic (e.g., a plano convex lens shown here) 554. In lighting system 500, a light source 501, such as an LED array is positioned at a first focal plane 508 of the curved reflector 502. Whereas in lighting system 550, a virtual image of a light source (not shown), such as an LED array, is positioned at a first focal plane 558 of the reflector 552. The virtual image in the lighting system 550 is generated by placing the light source within a focal length of the cylindrical optic 554. The cylindrical optic reduces the angular spread or divergence of the rays impinging on the curved reflector. Thus, rays 510 from the light source positioned at the first focal plane 508 and impinging the curved reflector 502 of the lighting system 500 are more divergent than rays 560 impinging the curved reflector 552 of the lighting system 550. Curved reflector 502 is consequently larger in order to collect all the rays from the light source. On the other hand, when the cylindrical optic 554 is utilized, the rays impinging on the curved reflector 552 are closer together (i.e., having a smaller angular spread). This allows the use of curved reflector 552, which is smaller than the curved reflector 502, for the same working distance. In this example, the working distance of 75 mm is the distance between the curved reflector 502 and a second focal plane 506, (for lighting system 500), and the distance between the curved reflector 552 and a second focal plane 556 (for lighting system 550). It will be appreciated that the working distance noted herein is exemplary, and working distances greater than or less than 75 mm are within the scope of this disclosure.

The larger curved reflector 502 in lighting system 500 results in a first optical path length of the emitting rays that is greater than a second optical path length of the emitting ray resulting from the smaller curved reflector 552 in lighting system 550. A higher intensity of irradiation and/or illumination is therefore achieved with the same working distance in lighting system 550, (using the cylindrical optic 554 and smaller curved reflector 552), than in the lighting system 500 without the cylindrical optic and larger curved reflector 502.

Further, while the second focal planes 506 and 556 respectively are shown as irradiance planes in this example, the irradiance plane may be positioned above or below the second focal planes 506, 556 in order to achieve generation of a more uniform multi-dimensional column of irradiance and/or illumination on the curable media.

Using the cylindrical optic 554 in lighting system 550 enables an angle of incidence of the reflected rays to be normal or adjusted to be normal to the curable media with a small rotation of the reflector 552. Normal incidence is not achieved in lighting system 500 due to the absence of a cylindrical optic, causing dramatic changes in the intensity of irradiance for small positional changes in the irradiance plane. It is therefore impossible to achieve a multi-dimensional column of light above or below the focal plane with a more uniform irradiance and/or illumination while achieving the desired intensity of irradiation and/or illumination. The irradiance plane is thus limited to the second focal plane 506 in lighting system 500. In contrast, due to the smaller reflector 552 and resulting normal incidence angle on the curable media, the irradiance plane 556 in lighting system 550 can be adjusted to be above or below the second focal plane while achieving the desired intensity of irradiation. Further, at the second focal plane 506, only a one-dimensional line of light is generated. Whereas, when the irradiance plane is positioned above or below the second focal plane 556, (which is possible only with the use of cylindrical optic 554); a multi-dimensional uniform column of light may be generated at the irradiance plane. The surface area of the curable media being irradiated and/or illuminated using lighting system 500 over a given exposure time, is less than the surface area of the curable media being irradiated and/or illuminated with lighting system 550 for the same time duration. Consequently, faster curing times can be achieved with lighting system 550 (including the cylindrical optic 554), than with lighting system 500 without the cylindrical optic.

Taken together, by utilizing a refractive cylindrical optic in a lighting system for curable media, faster and more efficient curing can be achieved. Further, due to the reduced size of the reflector, the curing system size can be reduced, and higher irradiance can be achieved without complex positional adjustments of the light source and reflector. Furthermore, when it is desired to change the reflector (e.g., for different working distances), the curing system can be assembled with ease by installing the desired reflector with the desired working distance and adjusting an angle of rotation of the reflector in a translational manner to achieve normal incidence on the curable media.

In one example, a desired angle of rotation for each size of curved reflector (when a cylindrical optic is used) may be predetermined and stored in a memory of a controller. Upon installing a curved reflector, the controller may be configured to detect the size of the curved reflector and rotate the curved reflector by the desired angle to provide normal incidence.

In some examples, upon installing a curved reflector, the lighting system may be calibrated to determine the angle at which normal incidence is achieved at the second focal plane; based on the intensity of irradiance and set-up at the angle of rotation.

Next, FIG. 6 shows a top view 602 of an example lighting system 600 without cylindrical optic, a side view 604 of the lighting system 600, and a front view 606 of the lighting system 600. Lighting system 600 includes a curved reflector 610. The curved reflector may be an elliptical reflector or a parabolic reflector.

Next, FIG. 7 shows a top view 702 of an example lighting system 700 with cylindrical optic, a side view 704 of the lighting system 700, and a front view 706 of the lighting system 700. The lighting system 700 includes a curved reflector 708 and a cylindrical optic 710. The curved reflector 708 may be an elliptical reflector or a parabolic reflector. The cylindrical optic 710 may be a plano-convex lens or other refractive cylindrical optic.

A cross-section of lighting system 700 is shown in FIG. 8. As discussed above, lighting system 700 includes the curved reflector 708 and the cylindrical optic 710. Lighting system 700 further includes a light source 806, which may be comprised of an array of LEDs. In one case, the light source may consist of a one-dimensional (single row) of densely-packed LEDs. An example one-dimensional array comprising discrete emitters 902 is shown in the perspective view in FIG. 9. In other examples, the light source may be any two-dimensional "m×n" array, where m=1, 2, 3 . . . etc., and n=1, 2, 3 . . . etc.

Referring now to FIG. 10, a block diagram of a photoreactive system 10 in accordance with the systems and methods described herein is shown. In this example, the photoreactive system 10 comprises a lighting subsystem 100, a controller 108, a power source 102 and a cooling subsystem 18. The lighting subsystem 100 may be similar to lighting system 150 discussed in FIG. 1, lighting system 400 discussed in FIGS. 4A and 4B, lighting system 550 discussed in FIG. 5, and lighting system 700 discussed in FIG. 7.

The lighting subsystem 100 may comprise a plurality of light emitting devices 110. Light emitting devices 110 may be LED devices, for example. Selected of the plurality of light emitting devices 110 are implemented to provide radiant output 24. The radiant output 24 is directed to a work piece 26. Returned radiation 28 may be directed back to the lighting subsystem 100 from the work piece 26, (e.g., via reflection of the radiant output 24).

The radiant output 24 may be directed to the work piece 26 via coupling optics 30. The coupling optics 30, if used, may be variously implemented. As an example, the coupling optics may include one or more layers, materials or other structure interposed between the light emitting devices 110 providing radiant output 24 and the work piece 26. As an example, the coupling optics 30 may include a micro-lens array to enhance collection, condensing, collimation or otherwise the quality or effective quantity of the radiant output 24. As another example, the coupling optics 30 may include a micro-reflector array. In employing such micro-reflector array, each semiconductor device providing radiant output 24 may be disposed in a respective micro-reflector, on a one-to-one basis.

Each of the layers, materials or other structure may have a selected index of refraction. By properly selecting the index of refraction of each material, reflection at the interfaces between each layer, and other structure in the path of the radiant output 24 (and/or returned radiation 28) may be selectively controlled. As an example, by controlling differences in such indices of refraction at a selected interface disposed between the semiconductor devices to the work piece 26, reflection at that interface may be reduced, eliminated, or minimized, so as to enhance the transmission of radiant output at that interface for ultimate delivery to the work piece 26.

The coupling optics 30 may be employed for various purposes. Example purposes include, among others, to protect the light emitting devices 110, to retain cooling fluid associated with the cooling subsystem 18, to collect, condense and/or collimate the radiant output 24, to collect, direct or reject returned radiation 28, or for other purposes, alone or in combination. As a further example, the photoreactive system 10 may employ coupling optics 30 so as to enhance the effective quality or quantity of the radiant output 24, particularly as delivered to the work piece 26.

In one example, coupling optics 30 may include a cylindrical optic 31 and a curved reflector 32. The cylindrical optic 31 may be a refractive cylindrical optic with positive power, for example. In one example, the cylindrical optic may be configured as a plano-convex lens. The curved reflector 32 may be an elliptical or a parabolic reflector for example. The emitting rays from the lighting system 100 may be collected by the curved reflector 32 via the cylindrical optic 31 and delivered to the work piece 26.

The cylindrical optic 31 may be used to reduce an angle of divergence (also referred to herein as angular spread) of the rays emitted by the lighting sub system 100. The angle of divergence as defined herein is an angle between an emitting ray and a central emitting ray of the light source. When the lighting subsystem is positioned within a focal length of the cylindrical optic, a virtual image is formed. The virtual image has a reduced angular spread of emitting rays. In this way, by using a refractive cylindrical optic 31, the angular spread of the lighting system may be reduced. Consequently, a smaller reflector may be used to collect the rays from the lighting system 100 and deliver it to the work piece 26. The curved reflector 32 may be further adjusted to deliver at least a portion of reflected rays normal to the work piece. For example, the curved reflector may be pivoted at an angle with respect to an optical axis of the lighting system 100 in order to achieve normal incidence of a portion of reflected rays delivered to the curable media. In this way, the intensity of irradiation and/or illumination may be increased.

Further, the virtual image generated by the cylindrical optic 31 may be positioned at a first focal plane of the curved reflector 32, and re-imaged at a second focal plane of the curved reflector 32 or at a parallel plane within a threshold distance above or below the second focal plane. When the work piece 26 is positioned at the second focal plane, it is irradiated by a focused line of light including a portion of light incident normal to the workpiece. Consequently, higher intensity of irradiation may be achieved when using the cylindrical optic. When the work piece 26 is positioned at the parallel planes immediately above or below the second focal plane, the work piece 26 is irradiated by a multi-dimensional band of light including a portion of light incident normal to the workpiece.

Further, the angular spread of the lighting system may be reduced based on one or more of; a radius of curvature and a focal length of the cylindrical optic 31. For example, as the radius of curvature decreases, (i.e. the focal length gets smaller), the amount of reduction in the angular spread increases (that is, the angle of divergence decreases). Thus, as the focal length of the cylindrical optic decreases, the amount of reduction in angular spread increases. Consequently, a size of the curved reflector 32 is also based on one or more of the radius of curvature and focal length of the cylindrical optic 31. For example, as the radius of curvature of the cylindrical optic 31 decreases, the angle of divergence (angular spread) of the emitting rays decreases and consequently, the size of the curved reflector 32 required to collect the rays decreases.

As discussed above, by using a cylindrical optic, for a given working distance, a reduction in the size of the curved reflector 32, (which may be a reduction in a length of a major axis and/or minor axis of the reflector) may be achieved. Consequently, an optical path length of the light rays from the source to the work piece 26 is reduced. As a result, a higher irradiance and/or illuminance can be achieved at the work piece 26.

Selected of the plurality of light emitting devices 110 may be coupled to the controller 108 via coupling electronics 22, so as to provide data to the controller 108. As described further below, the controller 108 may also be implemented to control such data-providing semiconductor devices, (e.g., via the coupling electronics 22).

The controller 108 preferably is also connected to, and is implemented to control, each of the power source 102 and the cooling subsystem 18. Moreover, the controller 108 may receive data from power source 102 and cooling subsystem 18.

The data received by the controller 108 from one or more of the power source 102, the cooling subsystem 18, the lighting subsystem 100 may be of various types. As an example, the data may be representative of one or more characteristics associated with coupled semiconductor devices 110, respectively. As another example, the data may be representative of one or more characteristics associated with the respective component 12, 102, 18 providing the data. As still another example, the data may be representative of one or more characteristics associated with the work piece 26 (e.g., representative of the radiant output energy or spectral component(s) directed to the work piece). Moreover, the data may be representative of some combination of these characteristics.

The controller 108, in receipt of any such data, may be implemented to respond to that data. For example, responsive to such data from any such component, the controller 108 may be implemented to control one or more of the power source 102, cooling subsystem 18, and lighting subsystem 100, (including one or more such coupled semiconductor devices). As an example, responsive to data from the lighting subsystem indicating that the light energy is insufficient at one or more points associated with the work piece, the controller 108 may be implemented to either (a) increase the power source's supply of current and/or voltage to one or more of the semiconductor devices 110, (b) increase cooling of the lighting subsystem via the cooling subsystem 18 (i.e., certain light emitting devices, if cooled, provide greater radiant output), (c) increase the time during which the power is supplied to such devices, or (d) a combination of the above.

Individual semiconductor devices 110 (e.g., LED devices) of the lighting subsystem 100 may be controlled independently by controller 108. For example, controller 108 may control a first group of one or more individual LED devices to emit light of a first intensity, wavelength, and the like, while controlling a second group of one or more individual LED devices to emit light of a different intensity, wavelength, and the like. The first group of one or more individual LED devices may be within the same array of semiconductor devices 110, or may be from more than one array of semiconductor devices 110. Arrays of semiconductor devices 110 may also be controlled independently by controller 108 from other arrays of semiconductor devices 110 in lighting subsystem 100 by controller 108. For example, the semiconductor devices of a first array may be controlled to emit light of a first intensity, wavelength, and the like, while those of a second array may be controlled to emit light of a second intensity, wavelength, and the like.

As a further example, under a first set of conditions (e.g. for a specific work piece, photoreaction, and/or set of operating conditions) controller 108 may operate photoreactive system 10 to implement a first control strategy, whereas under a second set of conditions (e.g. for a specific work piece, photoreaction, and/or set of operating conditions) controller 108 may operate photoreactive system 10 to implement a second control strategy. As described above, the first control strategy may include operating a first group of one or more individual semiconductor devices (e.g., LED devices) to emit light of a first intensity, wavelength, and the like, while the second control strategy may include operating a second group of one or more individual LED devices to emit light of a second intensity, wavelength, and the like. The first group of LED devices may be the same group of LED devices as the second group, and may span one or more arrays of LED devices, or may be a different group of LED devices from the second group, and the different group of LED devices may include a subset of one or more LED devices from the second group.

The cooling subsystem 18 is implemented to manage the thermal behavior of the lighting subsystem 100. For example, generally, the cooling subsystem 18 provides for cooling of such subsystem 12 and, more specifically, the semiconductor devices 110. The cooling subsystem 18 may also be implemented to cool the work piece 26 and/or the space between the piece 26 and the photoreactive system 10 (e.g., particularly, the lighting subsystem 100). For example, cooling subsystem 18 may be an air or other fluid (e.g., water) cooling system.

The photoreactive system 10 may be used for various applications. Examples include, without limitation, curing applications ranging from ink printing to the fabrication of DVDs and lithography. Generally, the applications in which the photoreactive system 10 is employed have associated parameters. That is, an application may include associated operating parameters as follows: provision of one or more levels of radiant power, at one or more wavelengths, applied over one or more periods of time. In order to properly accomplish the photoreaction associated with the application, optical power may need to be delivered at or near the work piece at or above a one or more predetermined levels of one or a plurality of these parameters (and/or for a certain time, times or range of times).

In order to follow an intended application's parameters, the semiconductor devices 110 providing radiant output 24 may be operated in accordance with various characteristics associated with the application's parameters, e.g., temperature, spectral distribution and radiant power. At the same time, the semiconductor devices 110 may have certain operating specifications, which may be are associated with the semiconductor devices' fabrication and, among other things, may be followed in order to preclude destruction and/or forestall degradation of the devices. Other components of the photoreactive system 10 may also have associated operating specifications. These specifications may include ranges (e.g., maximum and minimum) for operating temperatures and applied, electrical power, among other parameter specifications.

Accordingly, the photoreactive system 10 supports monitoring of the application's parameters. In addition, the photoreactive system 10 may provide for monitoring of semiconductor devices 110, including their respective characteristics and specifications. Moreover, the photoreactive system 10 may also provide for monitoring of selected other components of the photoreactive system 10, including their respective characteristics and specifications.

Providing such monitoring may enable verification of the system's proper operation so that operation of photoreactive system 10 may be reliably evaluated. For example, the system 10 may be operating in an undesirable way with respect to one or more of the application's parameters (e.g., temperature, radiant power, etc.), any components characteristics associated with such parameters and/or any component's respective operating specifications. The provision of monitoring may be responsive and carried out in accordance with the data received by controller 108 by one or more of the system's components.

Monitoring may also support control of the system's operation. For example, a control strategy may be implemented via the controller 108 receiving and being responsive to data from one or more system components. This control, as described above, may be implemented directly (e.g., by controlling a component through control signals directed to the component, based on data respecting that components operation) or indirectly (e.g., by controlling a component's operation through control signals directed to adjust operation of other components). As an example, a semiconductor device's radiant output may be adjusted indirectly through control signals directed to the power source 102 that adjust power applied to the lighting subsystem 100 and/or through control signals directed to the cooling subsystem 18 that adjust cooling applied to the lighting subsystem 100.

Control strategies may be employed to enable and/or enhance the system's proper operation and/or performance of the application. In a more specific example, control may also be employed to enable and/or enhance balance between the array's radiant output and its operating temperature, so as, e.g., to preclude heating the semiconductor devices 110 or array of semiconductor devices 110 beyond their specifications while also directing radiant energy to the work piece 26 sufficient to properly complete the photoreaction(s) of the application.

In some applications, high radiant power may be delivered to the work piece 26. Accordingly, the subsystem 12 may be implemented using an array of light emitting semiconductor devices 110. For example, the subsystem 12 may be implemented using a high-density, light emitting diode (LED) array. Although LED arrays may be used and are described in detail herein, it is understood that the semiconductor devices 110, and array(s) of same, may be implemented using other light emitting technologies without departing from the principles of the description, examples of other light emitting technologies include, without limitation, organic LEDs, laser diodes, other semiconductor lasers.

The plurality of semiconductor devices 110 may be provided in the form of an array 20, or an array of arrays. The array 20 may be implemented so that one or more, or most of the semiconductor devices 110 are configured to provide radiant output. At the same time, however, one or more of the array's semiconductor devices 110 are implemented so as to provide for monitoring selected of the array's characteristics. The monitoring devices 36 may be selected from among the devices in the array 20 and, for example, may have the same structure as the other, emitting devices. For example, the difference between emitting and monitoring may be determined by the coupling electronics 22 associated with the particular semiconductor device (e.g., in a basic form, an LED array may have monitoring LEDs where the coupling electronics provides a reverse current, and emitting LEDs where the coupling electronics provides a forward current).

Furthermore, based on coupling electronics, selected of the semiconductor devices in the array 20 may be either/both multifunction devices and/or multimode devices, where (a) multifunction devices are capable of detecting more than one characteristic, (e.g., either radiant output, temperature, magnetic fields, vibration, pressure, acceleration, and other mechanical forces or deformations) and may be switched among these detection functions in accordance with the application parameters or other determinative factors and (b) multimode devices are capable of emission, detection and some other mode (e.g., off) and are switched among modes in accordance with the application parameters or other determinative factors.

Turning now to FIG. 11, example intensity maps 1100 and 1150 are shown and consist of irradiation and/or illumination that may be achieved with a lighting system utilizing a cylindrical optic and a curved reflector, as described in the present invention. By utilizing a cylindrical optic 1106 as discussed above, a curved reflector 1102 may be adjusted to deliver at least a portion of the reflected rays 1104 normal to the irradiance plane. When normal incidence is achieved, an intensity of irradiance and illumination is increased, as indicated by peak 1108 in map 1100. Map 1150 shows intensity of irradiation from a lighting source 1152, where the lighting source may be an LED array.

Further, maps 1100 and 1150 show intensities of irradiation and/or illumination at the second focal plane 1110 of the curved reflector 1102. Light from the light source reflected by the curved reflector 1102 may be focused at the second focal plane 1110. In one example, the light reflected by the curved reflector 1102 may be directed onto a curable media positioned above or below the second focal plane 1110 in order to direct a multi-dimensional column of light onto the curable media. During such conditions, when the irradiance plane is above or below the second focal plane 1110, the light rays may not be focused; instead, a multi-dimensional diffuse column of light may be incident on the curable media. The intensity of irradiation at the irradiance place above or below the second focal plane 1110 may be less than the second focal plane but may not vary greatly from the intensity at the second focal plane and may remain within a threshold limit so as to enable curing of the curable media. The decrease in variation may be due to the normal incidence of a portion of light rays at the irradiance, which can be exploited to achieve a multi-dimensional column of irradiation on the curable media covering a greater surface area of the curable media. Consequently, curing may be achieved at a faster rate. An example of a multi-dimensional column of light is shown at FIG. 12. Specifically, an example multi-dimensional diffuse column of light generated at an irradiance plane above or below the second focal plane of a curved reflector is shown at 1202. The column of light 1202 may generated by an array of LEDs used as a light source and imaged via the cylindrical optic and the curved reflector. Further another example multi-dimensional diffused light generated at the irradiance plane above or below the focal plane is shown at 1204. The multi-dimensional light shown at 1204 may be generated when a discrete LED is used as a light source, for example. When multiple discrete LEDs are combined into an array of densely packed LEDs, and imaged at the irradiance place above or below the second focal plane, multi-dimensional column of light 1202 may be generated.

Figure 13:
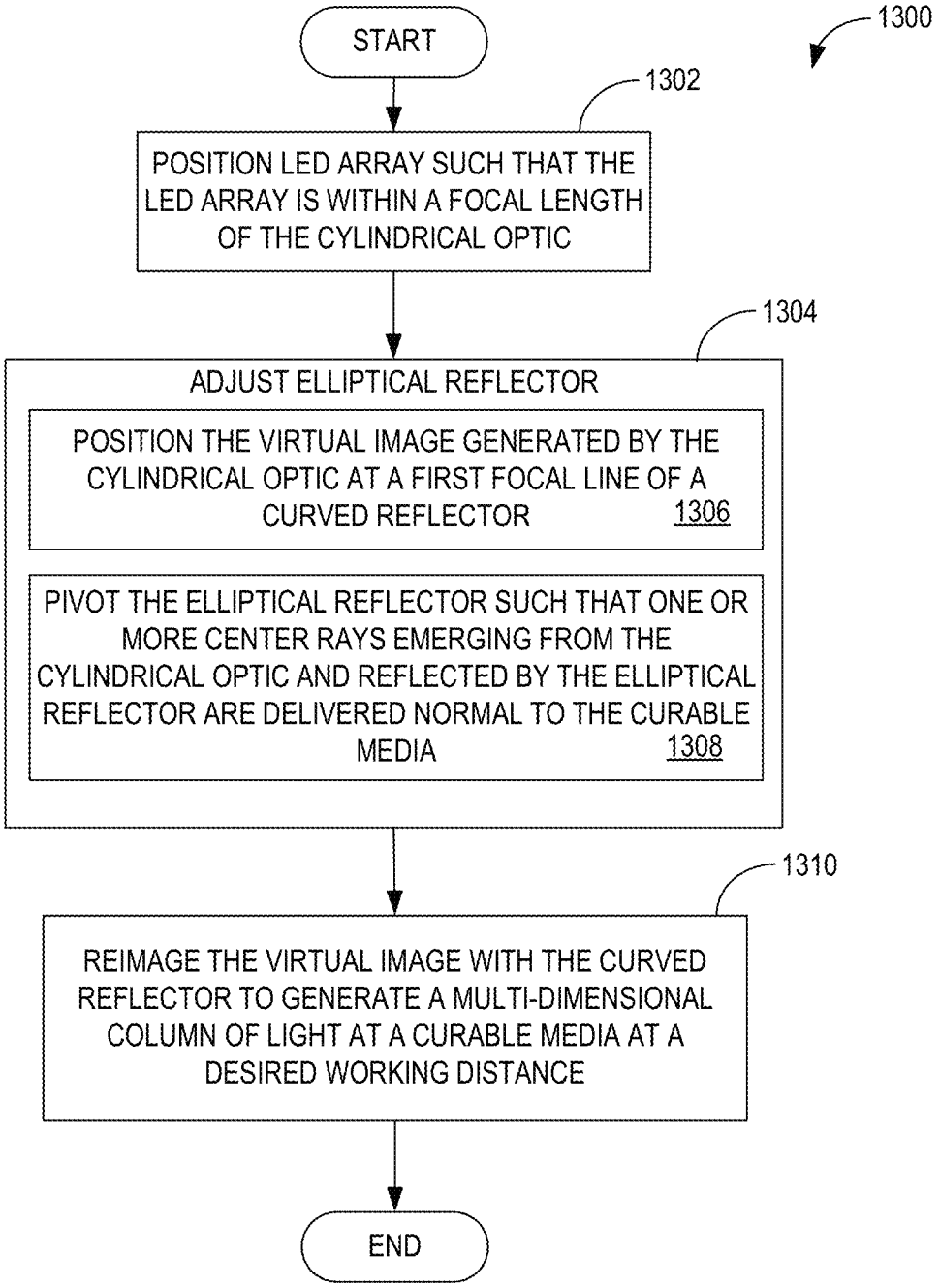
FIG. 13 shows a flowchart illustrating an example method for manufacturing a lighting system comprising a plurality of LEDs, a refractive cylindrical optic, and a curved reflector for irradiating a work piece including curable media with a multi-dimensional column of light.

Turning now to FIG. 13, a flowchart illustrating an example method 1300 for assembling/manufacturing a lighting system for generating a multi-dimensional column of light for curing a workpiece, such as work piece 26 at FIG. 10, is shown. The lighting system may be one or more of lighting system 100 shown in FIG. 10, lighting system 550 shown at FIG. 5, and lighting system shown at FIGS. 7 and 8. Method 1300 will be described with respect to FIGS. 5, 7, and/or 8 herein; however, it will be appreciated that method 1300 may be applied to other lighting systems including a refractive cylindrical optic and a curved reflector. Method 1300 may be applied to assemble coupling optics, such as coupling optics 30 in a photo-reactive system as shown in FIG. 10.

At 1302, method 1300 includes positioning a light source, such as an LED array, within a focal length of a cylindrical optic. The cylindrical optic may a refractive cylindrical optic with positive power. In one example, a plano-convex lens may be utilized as a cylindrical optic. In other examples, other types of refractive lenses, may be used. Depending on the desired reduction in the angular spread of the emitting rays from the light source, a radius of curvature of the cylindrical optic may be chosen. For example, if greater reduction in the angular spread of emitting rays is desired, a cylindrical optic with smaller radius of curvature may be chosen. Further, the light source may be positioned within a focal length of the refractive cylindrical optic so that a virtual image is generated behind the refractive cylindrical optic. The virtual image this generated may have a lesser angular spread than the light source. Consequently, a smaller curved reflector may be utilized.

Further, a material with a high silica content may be chosen for its inherently small coefficient of thermal expansion (as there may be a very high irradiance entering the lens). Higher-index materials may reduce the angular spread of light with the same radius of curvature, but this comes at a cost of increased transmission/reflection losses. If a small radius of curvature (large reduction in angular spread) is needed, a point is reached where the radius of curvature will be so small that higher-angle rays will totally internally reflect at the curved surface. In this case, a glass with a higher refractive index may be chosen with a larger radius of curvature that has the same amount of reduction in angular spread.

Next, method 1300 proceeds to 1304. At 1304, method 1300 includes adjusting the curved reflector. Adjusting the curved reflector includes, at 1306, adjusting a position of the virtual image such that the virtual image is at a first focal plane of the curved reflector. Adjusting the curved reflector further includes, at 1308, pivoting the curved reflector at an angle, such as angle φ indicated at FIG. 4A, in order to deliver at least a portion of the light rays normal to the work piece.

Next, at 1310, the virtual image is re-imaged with the curved reflector. In one example, the virtual image may be re-imaged at an irradiance plane parallel to a second focal plane and immediately above or below the second focal plane such that a multi-dimensional band of light is generated at the irradiance place and the work piece is irradiated and/or illuminated with a multi-dimensional band of light. The multi-dimensional band of light includes the portion of light rays that is incident normal to the work piece. In one example, a shape of the multi-dimensional band of light may be based on the properties of the cylindrical optic and curved reflector used.

In this way, by generating a virtual image of a light source with a cylindrical optic, angular spread (that is, angle of dispersion) of the emitting light rays from the light source is reduced. Consequently, a size of a curved reflector used to collect and deliver irradiance to a work piece is reduced. The reduced size of the curved reflector reduces an optical path length of the light rays from the light source to the work piece, which in turn allows for a higher intensity of irradiance and/or illumination at the work piece.

Further, by using the cylindrical optic and a smaller curved reflector, the reflector may be adjusted such that it is pivoted at an angle in order to deliver at least a portion of the irradiance and/or illumination at an angle normal (that is, 90 degrees) to the work piece. It must be noted that with the addition of the cylindrical optic, the normal incidence onto the work piece may be achieved by simply adjusting the pivot of the curved reflector. This in turn provides a consumer with increased ease of setting up the photo reactive system when the curved reflector is changed, such as for different working distances.

Furthermore, by using the cylindrical optic and the curved reflector, a multi-dimensional column of light may be generated for irradiating and/or illuminating the work piece, which increases a surface area of the work piece that is irradiated and/or illuminated at a given time duration. Consequently, a total duration for curing the entire work piece is reduced.

Accordingly, in one example, a method for curing ink in a printing system, comprises delivering light energy from a light source via a refractive cylindrical optic and a curved reflector to a work piece including generating a virtual image with the refractive cylindrical optic and reimaging the virtual image with the curved reflector to generate a multi-dimensional column of irradiance at the work piece, where at least a portion of the multi-dimensional column of irradiance delivered to the work piece is at an angle normal to a top surface of the work piece. A first example of the method includes wherein generating the virtual image with the refractive cylindrical optic includes positioning the light source within a focal length of the refractive cylindrical optic; wherein reimaging the virtual image with the curved reflector includes positioning the virtual image at a first focal line of the curved reflector. A second example of the method includes the first example, and further includes wherein the multi-dimensional column of irradiance is generated at a parallel plane above or below a focal plane including a second focal line receiving focused irradiance from the curved reflector.

In another representation, a method for manufacturing a photo reactive system includes positioning one or more discrete light sources within a focal length of a refractive cylindrical optic to generate a virtual image of the one or more discrete light sources; positioning the virtual image at a first focal plane of a curved reflector; and positioning an irradiance surface for receiving a curable media above or below a second focal plane of the curved reflector; wherein the curved reflector is adjusted to reimage the virtual image and deliver a multi-dimensional column of light onto the curable media positioned at the irradiance surface. The method further includes adjusting the curved reflector to deliver at least a portion of the multi-dimensional column of light at a first angle normal to the irradiance surface; wherein adjusting the curved reflector to deliver at least the portion of the multi-dimensional column of light at the first angle includes pivoting the curved reflector at a second angle with respect to an optical axis of the one or more discrete light sources. The method further includes wherein a size of the curved reflector is based on a focal length of the refractive cylindrical optic, the size of the curved reflector decreasing as the focal length of the refractive cylindrical optic decreases.

In another embodiment, a lighting system for treating a workpiece, comprises a light source; a refractive cylindrical optic; and a curved reflector, the light source positioned within a focal length of the cylindrical optic. A first example of the lighting system includes wherein the curved reflector is pivoted at an angle with respect to an optical axis of the light source. A second example of the lighting system optionally includes the first example and further includes wherein the light source includes an array of plurality of discrete light sources. A third example of the lighting system optionally includes one or more of the first and second examples, and further includes wherein the array is a one-dimensional array of light emitting diodes (LEDs) densely packed. A fourth example of the lighting system optionally includes one or more of the first through third examples, and further includes wherein the refractive cylindrical optic is a plano-convex lens. A fifth example of the lighting system optionally includes one or more of the first through fourth examples, and further includes wherein the refractive cylindrical optic is a meniscus lens with positive power. A sixth example of the lighting system optionally includes one or more of the first through fifth examples, and further includes wherein the curved reflector is an elliptical reflector. A seventh example of the lighting system optionally includes one or more of the first through sixth examples, and further includes wherein the curved reflector is a parabolic reflector. An eighth example of the lighting system optionally includes one or more of the first through seventh examples, and further includes wherein a size of the curved reflector is based on a radius of curvature of the refractive cylindrical optic. A ninth example of the lighting system optionally includes one or more of the first through eighth examples, and further includes wherein the curved reflector generates a multi-dimensional column of light above or below a focal plane of the curved reflector. A tenth example of the lighting system optionally includes one or more of the first through ninth examples, and further includes wherein the multi-dimensional column of light has a substantially uniform intensity.

In another embodiment, a photo reactive system, comprises a refractive cylindrical optic; one or more light emitting devices positioned within a focal length of the refractive cylindrical optic; and a curved reflector configured to reimage a virtual image generated by the refractive cylindrical optic, the virtual image positioned at a first focal plane of the curved reflector; wherein the curved reflector generates a multi-dimensional column of light above or below a second focal plane of the curved reflector; and wherein a portion of the multi-dimensional column of light is delivered at an angle normal to the second focal plane of the curved reflector. A first example of the photo reactive system includes wherein an angle of emitting rays impinging on the elliptical reflector with respect to a central emitting ray is based on a radius of curvature of the cylindrical optic, the angle of emitting rays decreasing as the radius of curvature of the cylindrical optic decreases; and wherein the refractive cylindrical optic is a plano-convex lens. A second example of the photo reactive system optionally includes the first example and further includes wherein the curved reflector is an elliptical reflector. A third example of the photo reactive system optionally includes one or more of the first and second examples, and further includes wherein the curved reflector is a parabolic reflector. A fourth example of the photo reactive system optionally includes one or more of the first through third examples, and further includes wherein the one or more light emitting devices are arranged in a two-dimensional array; and wherein the multi-dimensional column of light has a substantially uniform intensity. A fifth example of the photo reactive system optionally includes one or more of the first through fourth examples, and further includes wherein the curved reflector is pivoted at a second angle with respect to an optical axis of the one or more light emitting devices.

In another representation, a lighting system comprises a light source; a refractive cylindrical optic; and a curved reflector; wherein the light source is positioned within a focal length of the cylindrical optic to generate a virtual image of the light source; wherein the curved reflector is positioned such that the virtual image of the light source is along a first focal line on a first focal plane of the reflector; and wherein the curved reflector is shaped to reimage the virtual image and generate a multi-dimensional column of light, the multi-dimensional column of light directed onto a work piece. A first example of the lighting system includes wherein the multi-dimensional column of light is generated at an irradiance plane above or below a second focal plane of the curved reflector, the irradiance plane parallel to the second focal plane. A second example of the lighting system optionally includes the first example and further includes wherein at least a portion of the multi-dimensional column of light is delivered at a first angle normal to a second focal plane of the curved reflector. A third example of the lighting system optionally includes one or more of the first and second examples, and further includes wherein the curved reflector is pivoted at a second angle with respect to an optical axis of the light source. A fourth example of the lighting system optionally includes one or more of the first through third examples, and further includes wherein the light source includes an array of plurality of discrete light sources. A fifth example of the lighting system optionally includes one or more of the first through fourth examples, and further includes wherein the array is a one-dimensional array of light emitting diodes (LEDs) densely packed. A sixth example of the lighting system optionally includes one or more of the first through fifth examples, and further includes wherein the refractive cylindrical optic is a plano-convex lens. A seventh example of the lighting system optionally includes one or more of the first through sixth examples, and further includes wherein the refractive cylindrical optic is a meniscus lens with positive power. An eighth example of the lighting system optionally includes one or more of the first through seventh examples, and further includes wherein the curved reflector is an elliptical reflector. A ninth example of the lighting system optionally includes one or more of the first through eighth examples, and further includes wherein the curved reflector is a parabolic reflector. A tenth example of the lighting system optionally includes one or more of the first through ninth examples, and further includes wherein a size of the curved reflector is based on a radius of curvature of the refractive cylindrical optic, the size of the curved reflector decreasing as the radius of curvature of the refractive cylindrical optic decreases.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property. The terms "including" and "in which" are used as the plain-language equivalents of the respective terms "comprising" and "wherein." Moreover, the terms "first," "second," and "third," etc. are used merely as labels, and are not intended to impose numerical requirements or a particular positional order on their objects.

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. A lighting system for treating a workpiece, comprising:

a light source;

a refractive cylindrical optic;

a curved reflector, wherein the light source is positioned within a focal length of the refractive cylindrical optic to generate only one virtual image of the light source behind the refractive cylindrical optic; and a controller which both detects a size of the curved reflector and then rotates the curved reflector to provide normal incidence of light from the light source on the workpiece to be treated.

2. The lighting system of claim 1, wherein the curved reflector is configured to be pivoted at an angle with respect to an optical axis of the light source.

3. The lighting system of claim 1, wherein the curved reflector generates a multi-dimensional column of light above or below a focal plane of the curved reflector.

4. The lighting system of claim 3, wherein the multi-dimensional column of light has a substantially uniform intensity.

5. The lighting system of claim 1, wherein the light source includes an array of a plurality of discrete light sources.

6. The lighting system of claim 5, wherein the array is a one-dimensional array of light emitting diodes (LEDs).

7. The lighting system of claim 1, wherein the refractive cylindrical optic is a plano-convex lens.

8. The lighting system of claim 1, wherein the refractive cylindrical optic is a meniscus lens with positive power.

9. The lighting system of claim 1, wherein the curved reflector is an elliptical reflector.

10. The lighting system of claim 1, wherein the curved reflector is a parabolic reflector.

11. The lighting system of claim 1, wherein a size of the curved reflector is based on a radius of curvature of the refractive cylindrical optic.

12. A photo reactive system, comprising:

a refractive cylindrical optic including a flat surface and a curved surface, the curved surface positioned opposite to the flat surface;

one or more light emitting devices positioned within a focal length of the refractive cylindrical optic, the one or more light emitting devices emit rays at an angle with respect to a center line normal to an emitting surface of the one or more light emitting devices;

a curved reflector configured to collect the emitting rays and reimage an only one virtual image generated by the refractive cylindrical optic, the only one virtual image positioned at a first focal plane of the curved reflector, wherein the curved reflector generates a multi-dimensional column of light above or below a second focal plane of the curved reflector; and a controller configured to detect a size of the curved reflector and rotate the curved reflector by a second angle such that a portion of the multi-dimensional column of light is delivered perpendicularly to the second focal plane of the curved reflector, wherein the second angle is with respect to an optical axis of the one or more light emitting devices.

13. The photo reactive system of claim 12, wherein the angle of emitting rays impinging on the curved reflector with respect to the center line is based on a radius of curvature of the refractive cylindrical optic, the angle of emitting rays decreasing as the radius of curvature of the refractive cylindrical optic decreases; and wherein the refractive cylindrical optic is a plano-convex lens.

14. The photo reactive system of claim 12, wherein the curved reflector is an elliptical reflector.

15. The photo reactive system of claim 12, wherein the curved reflector is a parabolic reflector.

16. The photo reactive system of claim 12, wherein the one or more light emitting devices are arranged in a two-dimensional array; and wherein the multi-dimensional column of light has a substantially uniform intensity.

17. The photo reactive system of claim 12, wherein the curved reflector is pivoted at the second angle with respect to the optical axis of the one or more light emitting devices.

* * * * *